US011209151B2

(12) United States Patent
Dong et al.

(10) Patent No.: US 11,209,151 B2
(45) Date of Patent: Dec. 28, 2021

(54) LIGHTING APPARATUS

(71) Applicant: XIAMEN LEEDARSON LIGHTING CO., LTD, Fujian (CN)

(72) Inventors: Yongzhe Dong, Fujian (CN); Jiahong Chen, Fujian (CN); Shouqiang Hou, Fujian (CN); Xiaoliang Wen, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/133,611

(22) Filed: Dec. 23, 2020

(65) Prior Publication Data

US 2021/0325029 A1 Oct. 21, 2021

(30) Foreign Application Priority Data

Apr. 20, 2020 (CN) ..... 202020589489.1

(51) Int. Cl.

| | |
|---|---|
| ***F21V 23/00*** | (2015.01) |
| ***F21V 29/70*** | (2015.01) |
| ***F21V 17/16*** | (2006.01) |
| ***F21V 23/06*** | (2006.01) |
| *F21Y 115/10* | (2016.01) |

(52) U.S. Cl.

CPC ..... *F21V 29/70* (2015.01); *F21V 17/16* (2013.01); *F21V 23/007* (2013.01); *F21V 23/06* (2013.01); *F21Y 2115/10* (2016.08)

(58) Field of Classification Search

CPC ..... F21V 29/70; F21V 23/06; F21V 23/007; F21V 17/16; F21Y 2115/10

See application file for complete search history.

(56) References Cited

U.S. PATENT DOCUMENTS

| | | | | |
|---|---|---|---|---|
| 2009/0174838 | A1* | 7/2009 | Park | G09F 13/04 349/64 |
| 2012/0176795 | A1* | 7/2012 | Lynch | F21V 29/773 362/249.02 |
| 2014/0000956 | A1* | 1/2014 | Wurms | H02G 3/08 174/535 |
| 2014/0354155 | A1* | 12/2014 | Clifford | F21K 9/23 315/113 |
| 2017/0184284 | A1* | 6/2017 | Van Winkle | F21V 23/04 |
| 2017/0307183 | A1* | 10/2017 | Boomgaarden | F21V 7/06 |

(Continued)

*Primary Examiner* — Britt D Hanley
*Assistant Examiner* — Glenn D Zimmerman
(74) *Attorney, Agent, or Firm* — Chun-Ming Shih; Lanway IPR Services

(57) ABSTRACT

A lighting apparatus includes a driver box, a driver module and a light module. The driver box includes a surrounding wall and a top cover. The surrounding wall has multiple rectangular plates. A hinge structure is disposed for connecting the surrounding wall and the top cover so that the top cover is rotatable with respect to the surrounding wall to expose a container space enclosed by the surrounding wall. An elastic clip has a first clip end fixed to the surrounding wall and has a second clip end for elastically deformed to either lock or release the top cover to rotate with respect to the surrounding wall. The driver module is disposed in the container space of the surrounding wall. The driver module is connected to a power wire via a wiring hole disposed on the surrounding wall. The light module receives a driving current from the driver module.

17 Claims, 10 Drawing Sheets

(56) References Cited

U.S. PATENT DOCUMENTS

| | | | | |
|---|---|---|---|---|
| 2018/0249563 | A1* | 8/2018 | Alexander | G05B 15/02 |
| 2019/0021149 | A1* | 1/2019 | Knauss | H05B 47/19 |
| 2019/0027099 | A1* | 1/2019 | Kumar | F21V 23/045 |
| 2019/0203894 | A1* | 7/2019 | Zeng | F21V 29/70 |
| 2019/0226669 | A1* | 7/2019 | Winters | F21V 23/008 |

* cited by examiner

LIGHTING APPARATUS

FIELD

The present invention is related to a lighting apparatus, and more particularly related to a lighting apparatus with enhanced heat dissipation structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

When light devices are installed in various places, many different problems occur.

For example, there may be fire accident and the light devices need to be designed to prevent further damages on the fire accident.

It takes time and innovation to find out an effective solution while providing low cost and reliable design.

SUMMARY

In some embodiments, a lighting apparatus includes a driver box, a driver module and a light module.

The driver box includes a surrounding wall and a top cover.

The surrounding wall has multiple rectangular plates.

A hinge structure is disposed for connecting the surrounding wall and the top cover so that the top cover is rotatable with respect to the surrounding wall to expose a container space enclosed by the surrounding wall.

An elastic clip has a first clip end fixed to the surrounding wall and has a second clip end for elastically deformed to either lock or release the top cover to rotate with respect to the surrounding wall.

The driver module is disposed in the container space of the surrounding wall.

The driver module is connected to a power wire via a wiring hole disposed on the surrounding wall.

The light module receives a driving current from the driver module.

The driving current is generated by the driver module by rectifying an external power from the power wire.

In some embodiments, the multiple rectangular plates are made of metal material.

In some embodiments, the multiple rectangular plates are formed by bending a metal sheet.

In some embodiments, the wiring hole has a hole cover with breakable pins connected to the surrounding wall before the power wire is installed.

In some embodiments, the second clip end has an U-shape structure.

The U-shape structure has a first arm, a second arm and an arm connector.

The first arm and the second arm are connected by the arm connector.

The first arm elastically engages the top cover.

The second arm is used for being pressed to deform the second clip end for releasing the top cover.

In some embodiments, the light module has a back cover for fixing to the surrounding wall.

In some embodiments, the surrounding wall has multiple bottom ears for fixing to the back cover of the light module.

In some embodiments, the surrounding wall has multiple protruding pins for inserting to the back cover to align the surrounding wall with the back cover.

In some embodiments, the light module has a thermal conductive path connected to the surrounding wall for carrying heat of the light module to the surrounding wall.

In some embodiments, a wire pressing plate is disposed inside the surrounding wall for keeping the power wire in order.

In some embodiments, a power terminal is fixed on the surrounding wall for connecting to the power wire and the driver module.

In some embodiments, the surrounding wall has a guiding track for installing the driver module.

In some embodiments, there are multiple slots for selectively plugging multiple driver plates of the driver module.

In some embodiments, the multiple driver plates exchange a device signal for coordinating an operation among the multiple driver plates.

In some embodiments, the lighting apparatus may also include a conductive path module attached to the surrounding wall for connecting the power terminal and the driver module and for connecting the driver module to the light module.

In some embodiments, the top cover has a manual switch electrically connected to the driver module to adjust a setting of the driver module.

In some embodiments, the surrounding wall has a first air passage and a second air passage disposed at two positions of the driver box.

The two positions of the driver box have different temperatures when the light module is turned on.

In some embodiments, the lighting apparatus may also include a fan for heat dissipation.

The fan receives power from the driver module for moving air in the container space of the driver box.

In some embodiments, the top cover has a hexagon shape.

In some embodiments, an antenna is attached on the light module for electrically connecting to the driver module stored in the driver box.

DETAILED DESCRIPTION

Figure 11:
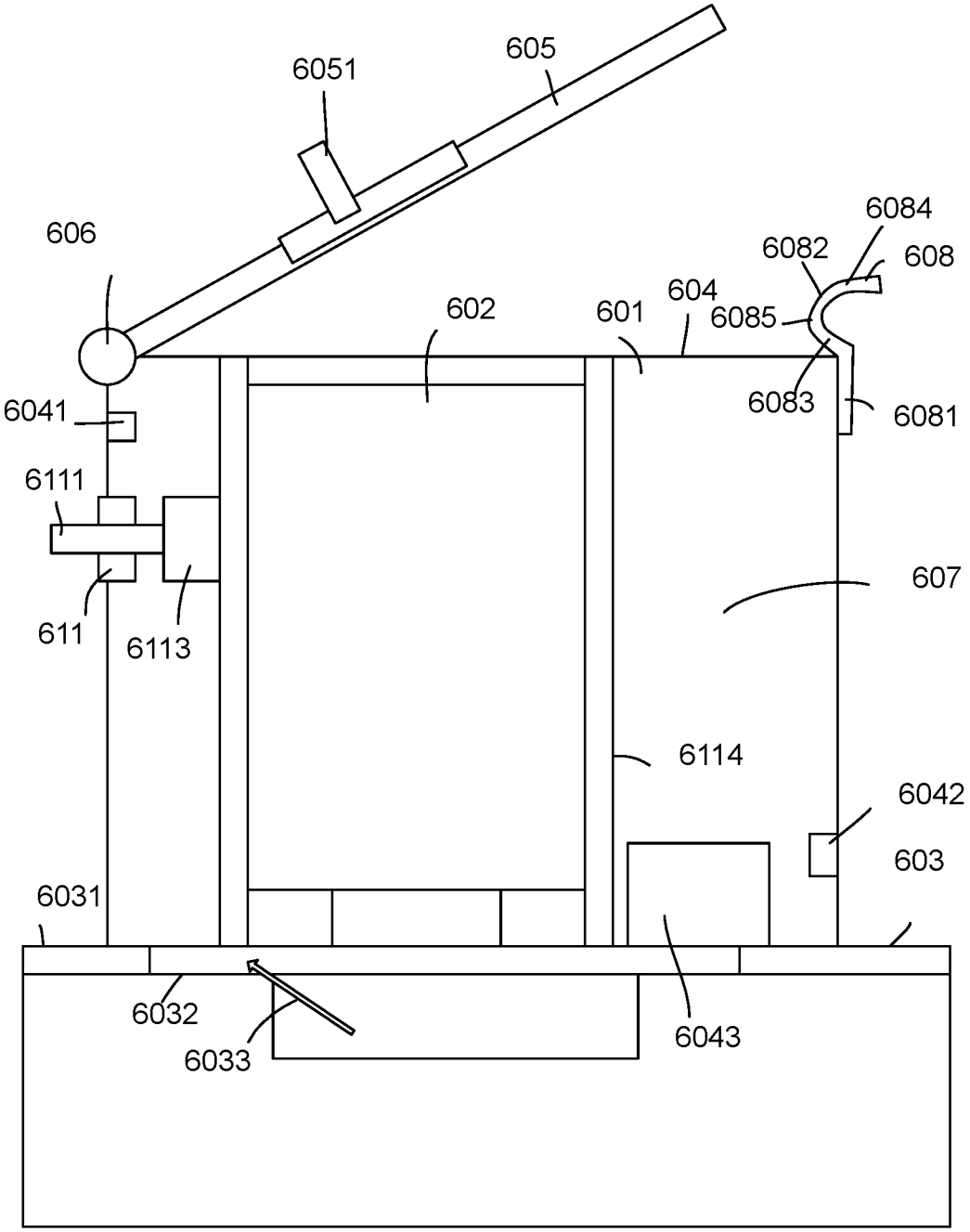
FIG. 11 illustrates another example of a lighting apparatus.

In FIG. 11, a lighting apparatus includes a driver box 601, a driver module 602 and a light module 603.

The driver box 601 includes a surrounding wall 604 and a top cover 605.

Figure 1:
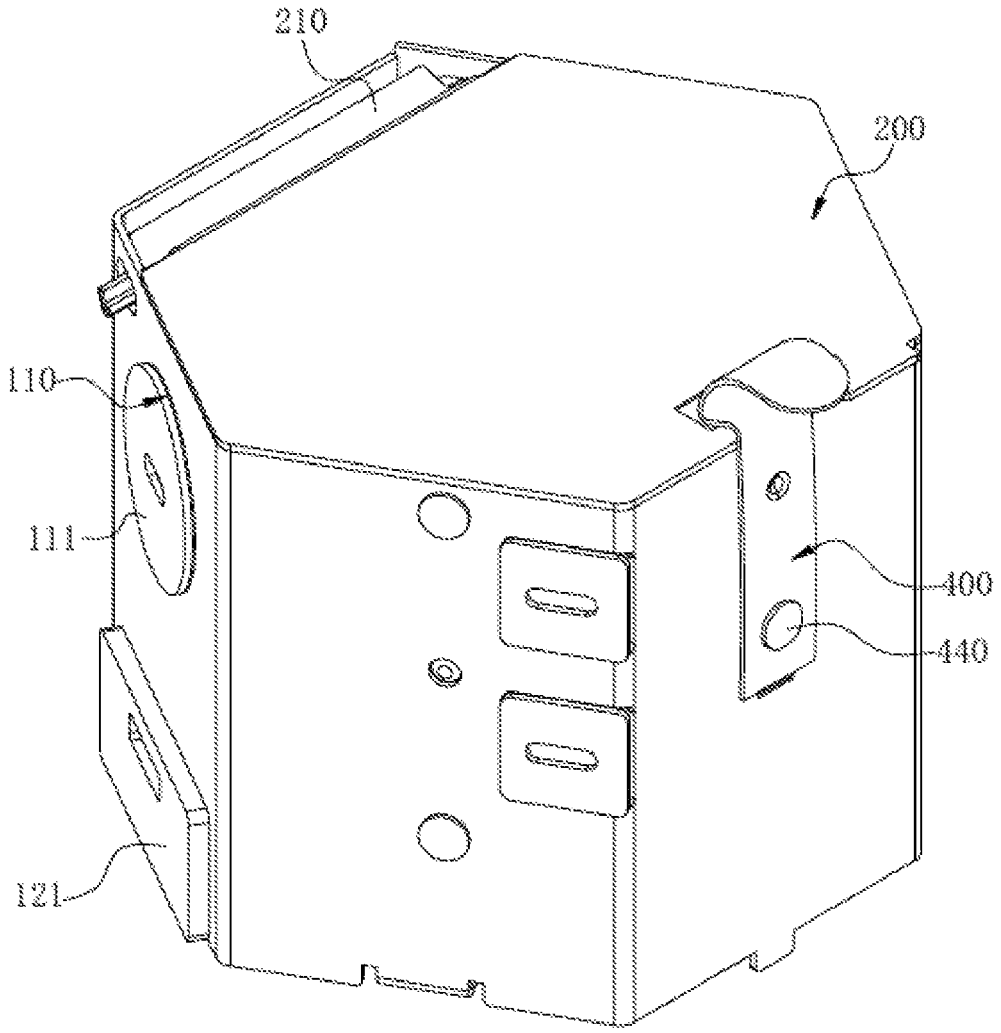
FIG. 1 illustrates a driver box example.

The surrounding wall 604 has multiple rectangular plates, as shown in the example of FIG. 1.

A hinge structure 606 is disposed for connecting the surrounding wall 601 and the top cover 605 so that the top cover 605 is rotatable with respect to the surrounding wall 604 to expose a container space 607 enclosed by the surrounding wall 604.

An elastic clip 608 has a first clip end 6081 fixed to the surrounding wall 604 and has a second clip end 6082 for elastically deformed to either lock or release the top cover 605 to rotate with respect to the surrounding wall 604.

The driver module 602 is disposed in the container space 607 of the surrounding wall 604.

The driver module 602 is connected to a power wire 6111 via a wiring hole 611 disposed on the surrounding wall 604.

The light module 603 receives a driving current from the driver module 602.

The driving current is generated by the driver module 602 by rectifying an external power from the power wire 6111. For example, the power wire 6111 is connected to an indoor power of 11V/220V alternating current power source. The driver module 602 converts the received power to a direct current power by rectifying, filtering and other processing. The direct current power is supplied to the light module, e.g. to one or more LED modules of the light module to emit lights. In addition, the LED module may contain one type or multiple types of LED chips for mixing lights of required color, color temperature or intensity. The driver module may also receive a command from a wire or a wireless channel to adjust the output of the light module.

In some embodiments, the multiple rectangular plates are made of metal material or plastic material with high thermal conductive material. In some embodiments, the rectangular plates are made of material that can keep stable under high temperature, e.g. under a fire accident.

In some embodiments, the multiple rectangular plates are formed by bending a metal sheet. Specifically, the metal sheet is folded to form the surrounding wall. There are some structures like the wiring hole made by stamping on the metal sheet.

Figure 2:
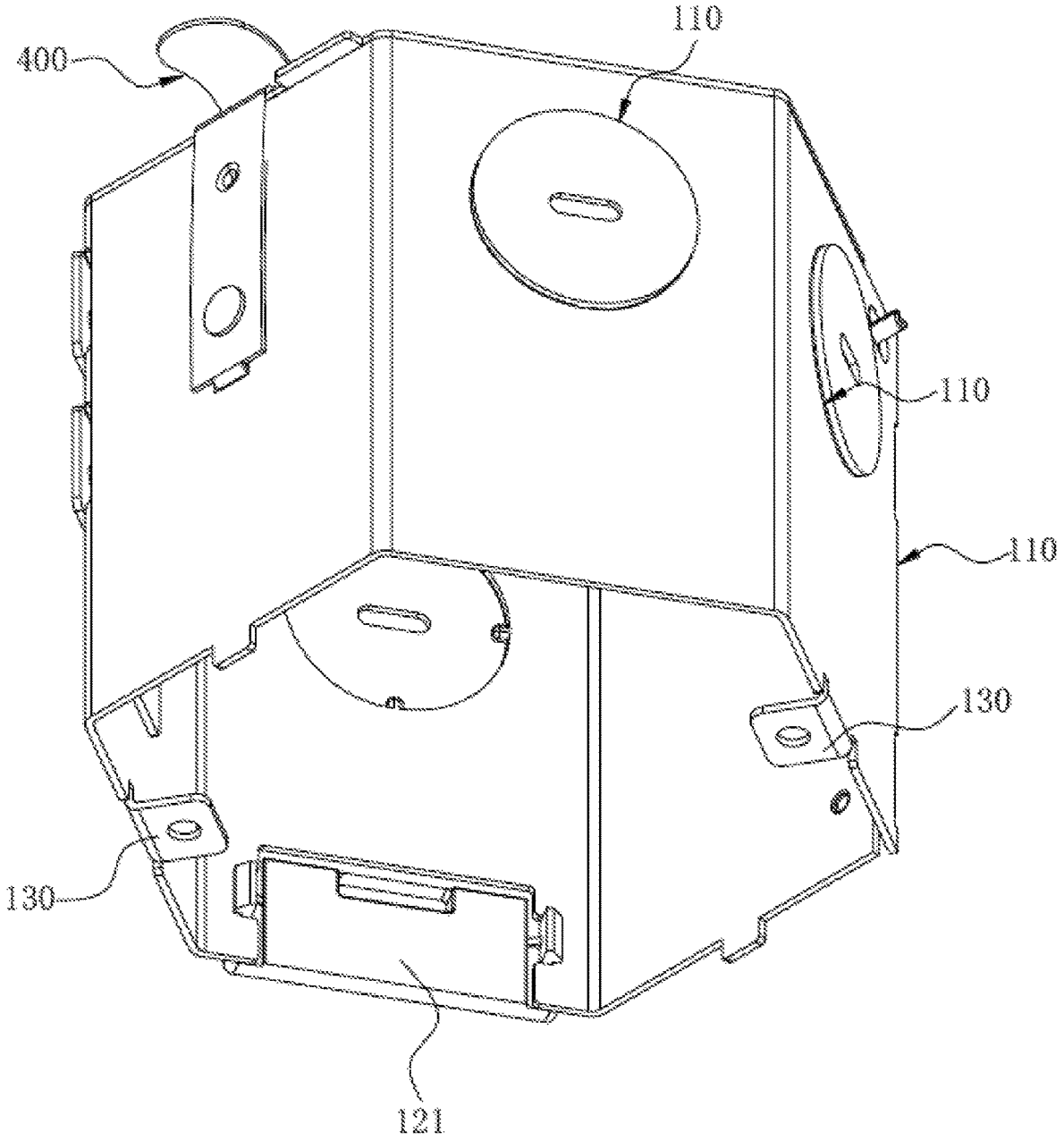
FIG. 2 illustrates another view of the example in FIG. 1.

In some embodiments, the wiring hole has a hole cover with breakable pins connected to the surrounding wall before the power wire is installed. For example, FIG. 2 shows a wiring hole 110 with a hole cover with only a minimum connecting pin connected to the surrounding wall. Users may easily break the wiring hole during installation or assembly of the lighting apparatus.

In FIG. 11, the second clip end 6082 has a U-shape structure.

The U-shape structure has a first arm 6083, a second arm 6084 and an arm connector 6085.

The first arm 6083 and the second arm 6084 are connected by the arm connector 6085.

The first arm 6083 elastically engages the top cover 605 when the top cover 605 is closed by engaging the surrounding wall 604.

The second arm 6084 is used for being pressed to deform the second clip end 6082 for releasing the top cover 605. The elastic clip 100 illustrated in FIG. 4, FIG. 9 and FIG. 10 may be used as reference to implement such structure.

In FIG. 11, the light module 603 has a back cover 6031 for fixing to the surrounding wall 604.

Figure 4:
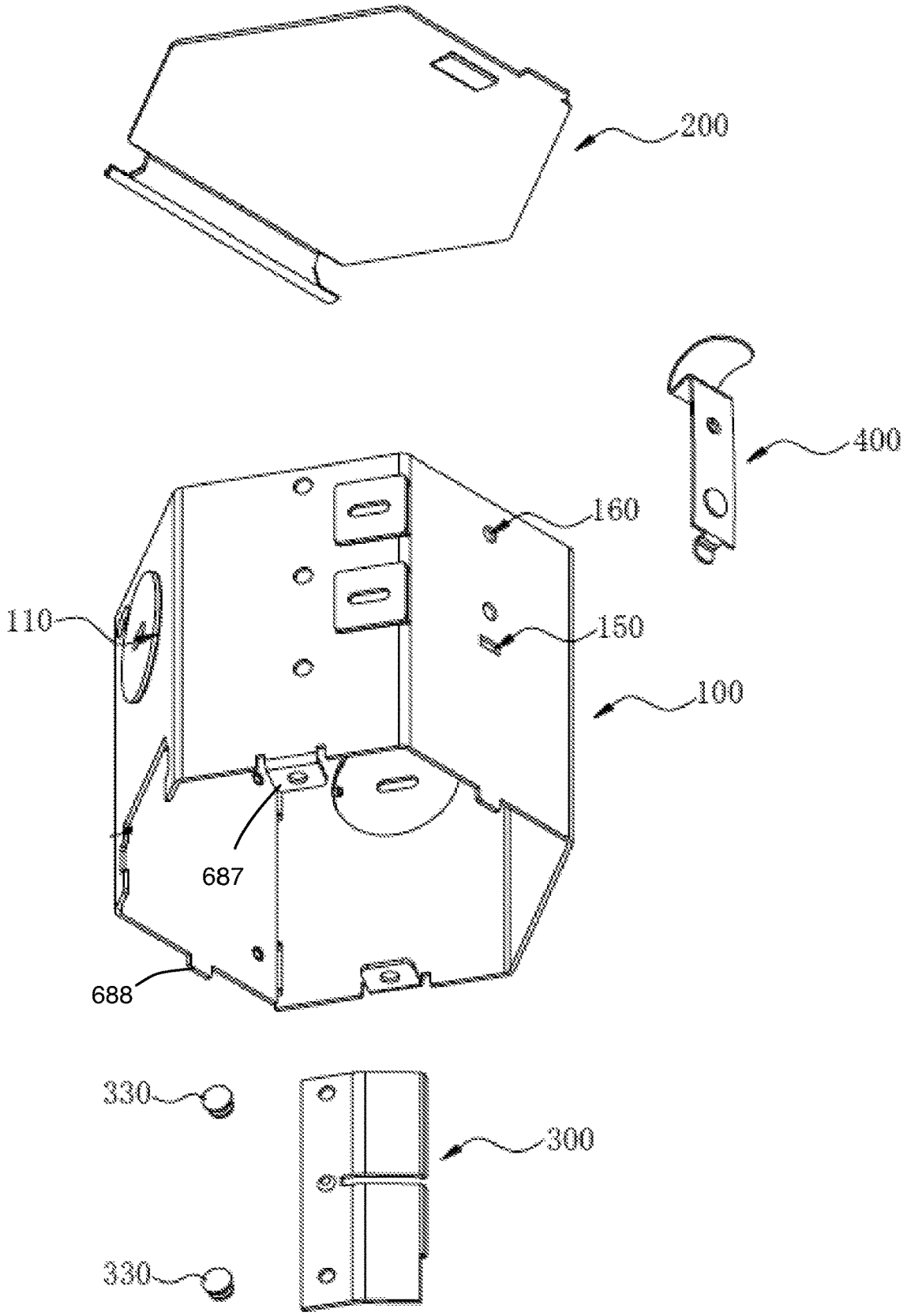
FIG. 4 illustrates another view of the exploded view in FIG. 3.

In FIG. 4, the surrounding wall has multiple bottom ears 687 for fixing to the back cover of the light module.

In FIG. 4, the surrounding wall has multiple protruding pins 688 for inserting to the back cover to align the surrounding wall with the back cover. Specifically, there are some positioning holes for inserting the protruding pins 688 on the back cover of the light module.

In FIG. 11, the light module 603 has a thermal conductive path 6032 connected to the surrounding wall 604 for carrying heat of the light module 603 to the surrounding wall 604. For example, the thermal conductive path 6032 may be made of a metal strip or plate for effectively moves heat 6033 to the surrounding wall 604 via the thermal conductive path 6032.

Figure 3:
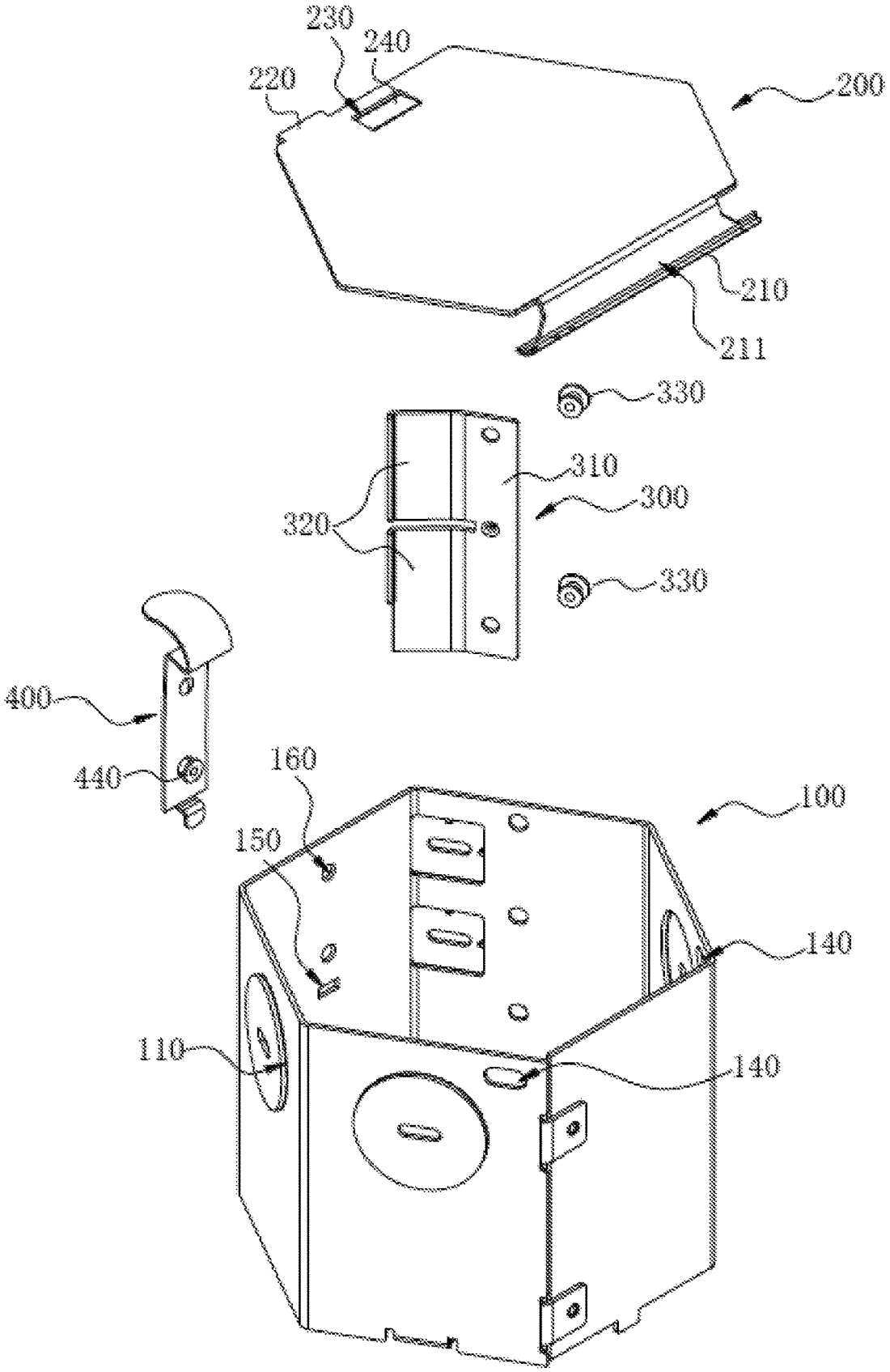
FIG. 3 illustrates an exploded view of the example in FIG. 1.

In FIG. 3, a wire pressing plate 300 is disposed inside the surrounding wall for keeping the power wire in order.

In FIG. 11, a power terminal 6113 is fixed on the surrounding wall 604 for connecting to the power wire 6111 and the driver module 602. The power terminal 6113 may include a structure and a conductive strip so that the power wire 6111 is structurally and electrically connected to the power terminal 6113. The driver 602 is electrically connected to the power wire 6111 via the power terminal 6113.

In some embodiments, the surrounding wall has a guiding track 6115 for installing the driver module 602. For example, the driver module 602 has a driver plate to be inserted to the container space 607 via the guiding track 6115. When the drive module 602 reaches a predetermined position, the driver module 602 also engages the power terminal 6113. Such design makes the assembly of the lighting apparatus more easily, which may also reduce the manufacturing cost.

In some embodiments, there are multiple slots for selectively plugging multiple driver plates of the driver module. FIG. 11 shows one driver module 602 is inserted via the guiding track 6114. Other driver plates mounted with further functions may be placed with the same manner. For example, a basic driver plate may provide power conversion while another driver plate provides wireless connection. Other driver plate may provide sensor or IoT automatic functions.

In some embodiments, the multiple driver plates exchange a device signal for coordinating an operation among the multiple driver plates. For example, multiple driver plates are inserted to the driver box via guiding tracks as mentioned above. There are corresponding terminals like the power terminal to combine these driver plates so that the components on these driver plates may communicate. For example, a main driver plate may send an inquiry command to an interface like I2C that connects the multiple driver plates. When another driver plate receives the inquiry command, the driver plate replies with its type and capability to the main driver plate. With such signal exchanges, multiple driver plates may work together automatically and smartly.

Figure 12:
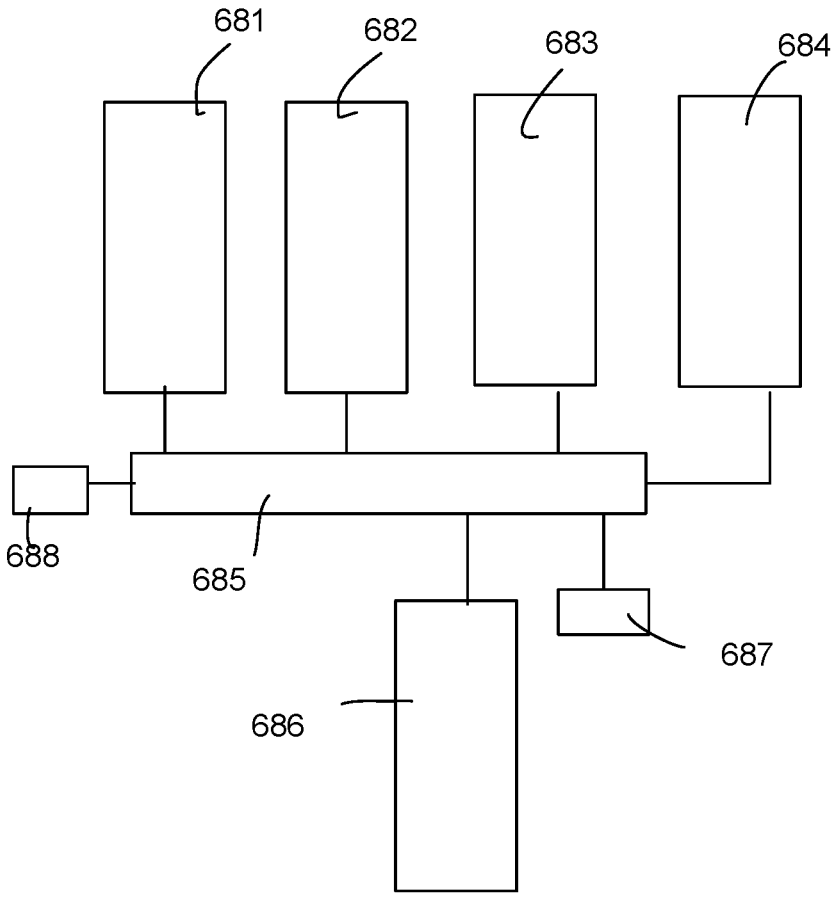
FIG. 12 shows a conductive path module used in the driver box.

In FIG. 12, the lighting apparatus may also include a conductive path module 685 attached to the surrounding wall for connecting the power terminal 688 and the driver module and for connecting the driver module to the light module 686. The conductive path module 685 may include multiple wires or metal strips with insulation structures to be installed inside the surrounding wall. Multiple driver plates 681, 682, 683, 684 may exchange signals or receive power via the conductive path module 685.

In FIG. 11, the top cover 605 has a manual switch 6051 electrically connected to the driver module 602, e.g. via the conductive path module mentioned above, to adjust a setting of the driver module 602.

In some embodiments, the surrounding wall has a first air passage 6041 and a second air passage 6042 disposed at two positions of the driver box 601.

The two positions of the driver box have different temperatures when the light module is turned on. For example, the first air passage 6041 is placed at a position with less temperature than the second air passage 6042. Therefore, the air would form a flow between the two air passages 6041, 6042.

In some embodiments, the lighting apparatus may also include a fan 6043 for heat dissipation.

The fan 6043 receives power from the driver module 602 for moving air in the container space of the driver box 601.

In some embodiments, the top cover has a hexagon shape, as shown in FIG. 1.

In FIG. 12, an antenna 687 is attached on the light module 686 for electrically connecting to the driver module stored in the driver box, e.g. via the conductive path module 685 to the driver plates 681, 682, 683, 684 that need to use an antenna.

Please refer to FIG. 1, which shows a driver box example.

In FIG. 1, the driver box has a top cover 200, a hinge 210, a wiring hole 110 and a wiring hole cover 111. There is also a switch protection cover 121 that may be removed during assembly or be rotated to open for inserting wires.

There is an elastic clip 400 fixed with a rivet 440 to keep the top cover 200 closed.

FIG. 2 shows another view of the example in FIG. 1. FIG. 2 further shows two connecting ears 130 to be fix to a top cover of a light module.

FIG. 3 shows the top cover 200 having a reversed edge 240 and a passing hole 230 to be held by the elastic clip 400. There is a pushing unit 220 with protruding portion to be pushed by users to open the top cover 200.

The hinge 210 has an escape groove 211. There are rivets 330 to fix fixing parts 310 of the a wire pressing plate 300 so as to allow an elastic holder part 320 to hold wires.

The surrounding wall 100 has multiple rectangular plates mounted with structures like a key hole 150, a positioning hole 160, installation holes 140 that may be formed with stamping on a metal sheet.

FIG. 4 shows another view of the example in FIG. 3.

Figure 5:
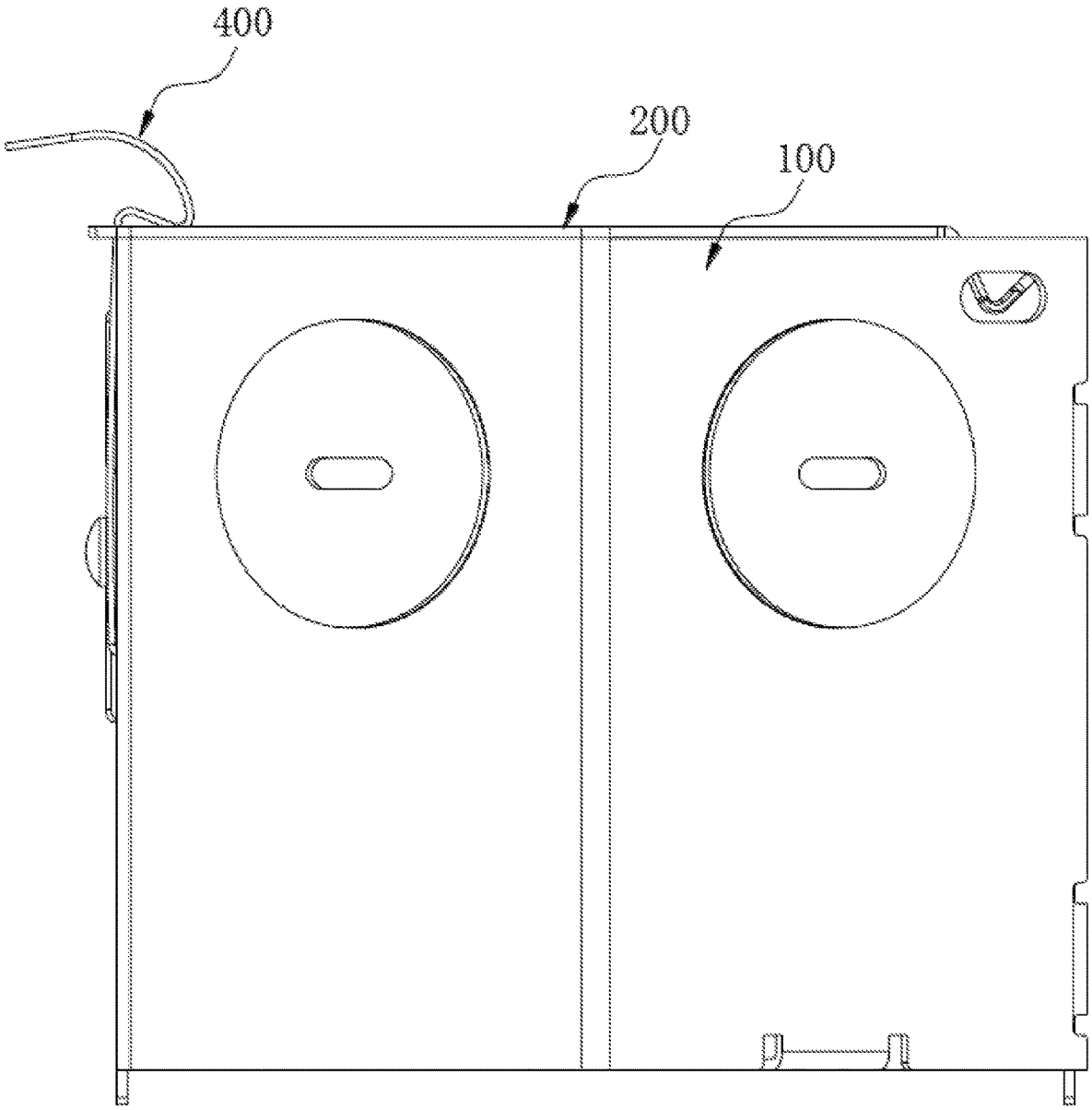
FIG. 5 illustrates a side view of the example in FIG. 1.

FIG. 5 shows another view of the example in FIG. 3.

Figure 6:
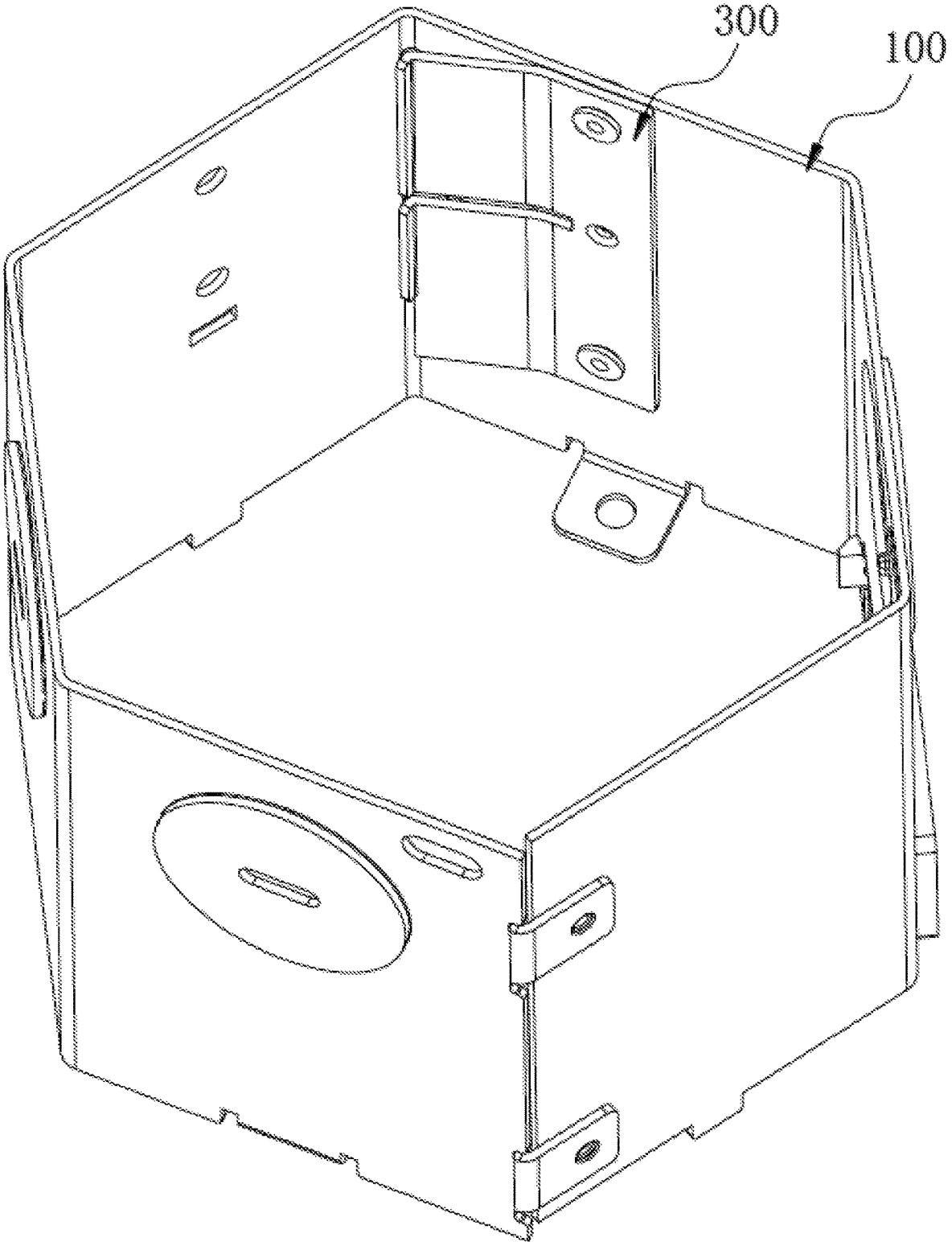
FIG. 6 illustrates another view of the example in FIG. 1.

FIG. 6 shows the wire pressing plate 300 installed on the surrounding wall 100.

Figure 7:
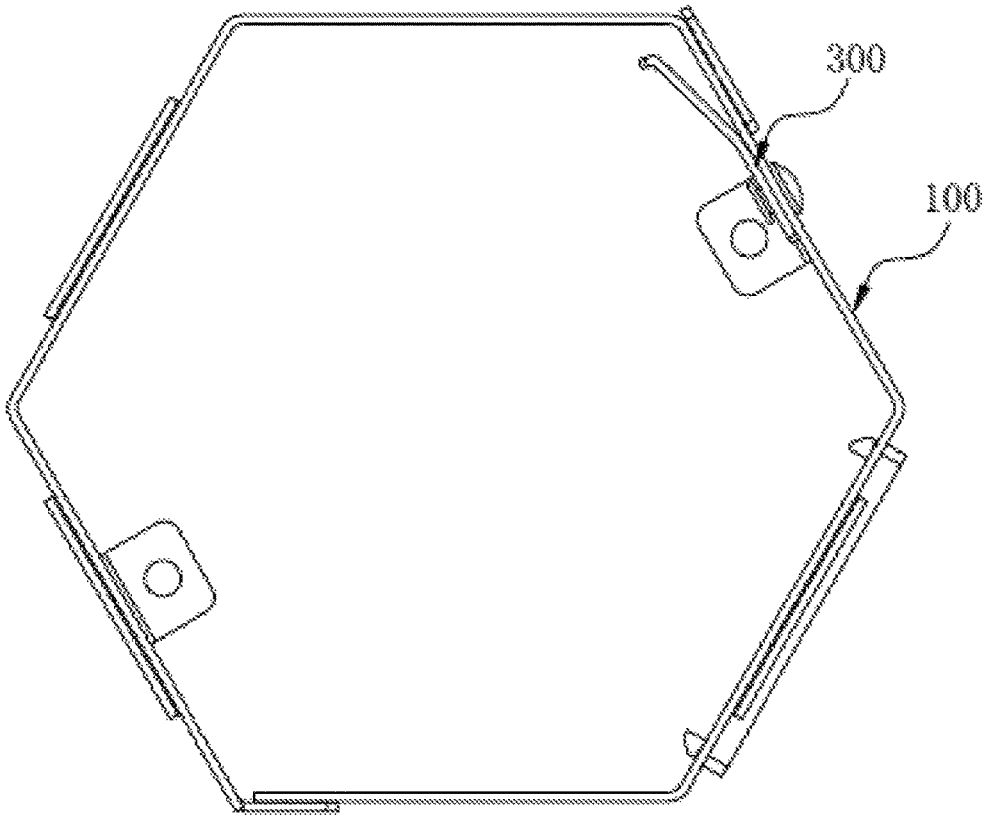
FIG. 7 illustrates a top view of the example in FIG. 1.

FIG. 7 shows a top view of the example in FIG. 6.

Figure 8:
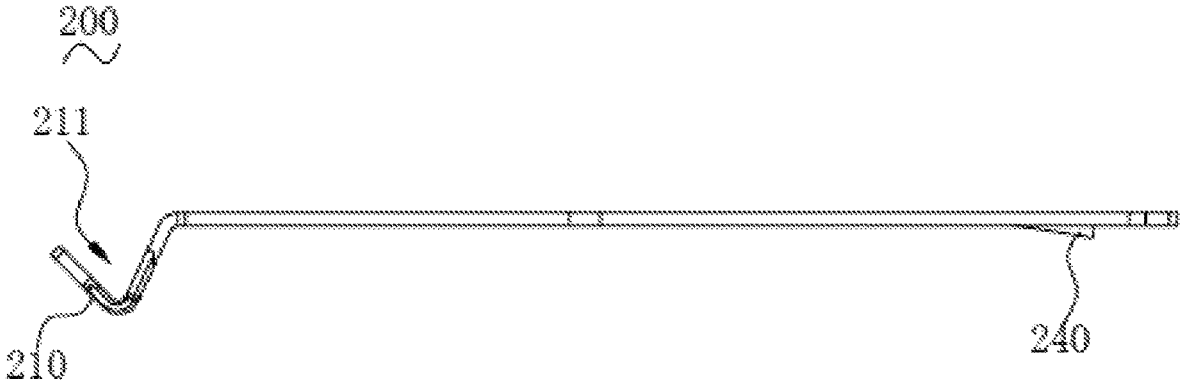
FIG. 8 illustrates a side view of the top cover.

FIG. 8 shows the top cover 200 having an escape groove 211 and a hinge axis 210. There is a reversed edge 240 on the top cover 200.

Figure 9:
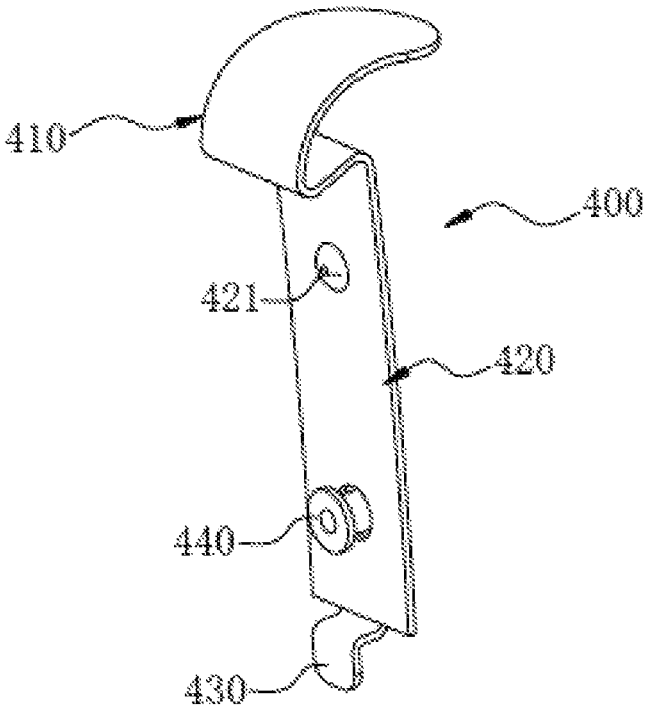
FIG. 9 illustrates an elastic clip example.

FIG. 9 shows an elastic clip 400. The elastic clip 400 has a holder part 410 and a pin 430. There is a fixing part 420 fixed to the surrounding wall with the protruding block 421 and the rivet 440.

Figure 10:
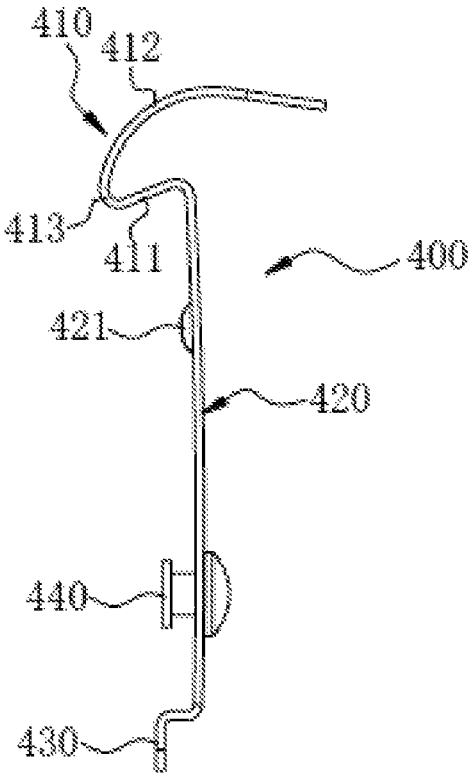
FIG. 10 illustrates a side view of the example in FIG. 9.

FIG. 10 further shows that the elastic clip 400 having a second arm 412 and a first arm 411 connected with an arm connector 413 forming a clip unit 410.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a driver box comprising a surrounding wall and a top cover, wherein the surrounding wall has multiple rectangular plates, a hinge structure is disposed for connecting the surrounding wall and the top cover so that the top cover is rotatable with respect to the surrounding wall to expose a container space enclosed by the surrounding wall, an elastic clip has a first clip end fixed to the surrounding wall and has a second clip end for elastically deformed to either lock or release the top cover to rotate with respect to the surrounding wall;

a driver module disposed in the container space of the surrounding wall, wherein the driver module is connected to a power wire via a wiring hole disposed on the surrounding wall; and a light module for receiving a driving current from the driver module, wherein the driving current is generated by the driver module by rectifying an external power from the power wire, wherein there are multiple slots for selectively plugging multiple driver plates of the driver module via guiding tracks on the surrounding wall, wherein the multiple driver plates exchange a device signal for coordinating an operation among the multiple driver plates.

2. The lighting apparatus of claim 1, wherein the multiple rectangular plates are made of metal material.

3. The lighting apparatus of claim 1, wherein the second clip end has an U-shape structure, the U-shape structure has a first arm, a second arm and an arm connector, the first arm and the second arm are connected by the arm connector, the first arm elastically engages the top cover, the second arm is used for being pressed to deform the second clip end for releasing the top cover.

4. The lighting apparatus of claim 1, wherein the light module has a back cover for fixing to the surrounding wall.

5. The lighting apparatus of claim 1, wherein a wire pressing plate is disposed inside the surrounding wall for keeping the power wire in order.

6. The lighting apparatus of claim 1, wherein a power terminal is fixed on the surrounding wall for connecting to the power wire and the driver module.

7. The lighting apparatus of claim 1, wherein the top cover has a manual switch electrically connected to the driver module to adjust a setting of the driver module.

8. The lighting apparatus of claim 1, wherein the surrounding wall has a first air passage and a second air passage disposed at two positions of the driver box, the two positions of the driver box have different temperatures when the light module is turned on.

9. The lighting apparatus of claim 1, wherein the top cover has a hexagon shape.

10. The lighting apparatus of claim 1, wherein an antenna is attached on the light module for electrically connecting to the driver module stored in the driver box.

11. The lighting apparatus of claim 2, wherein the multiple rectangular plates are formed by bending a metal sheet.

12. The lighting apparatus of claim 4, wherein the surrounding wall has multiple bottom ears for fixing to the back cover of the light module.

13. The lighting apparatus of claim 4, wherein the surrounding wall has multiple protruding pins for inserting to the back cover to align the surrounding wall with the back cover.

14. The lighting apparatus of claim 4, wherein the light module has a thermal conductive path connected to the surrounding wall for carrying heat of the light module to the surrounding wall.

15. The lighting apparatus of claim 6, further comprising a conductive path module attached to the surrounding wall for connecting the power terminal and the driver module and for connecting the driver module to the light module.

16. The lighting apparatus of claim 8, further comprising a fan for heat dissipation, the fan receives power from the driver module for moving air in the container space of the driver box.

17. The lighting apparatus of claim 11, wherein the wiring hole has a hole cover with breakable pins connected to the surrounding wall before the power wire is installed.

* * * * *